US007275818B2

(12) United States Patent
Figov et al.

(10) Patent No.: US 7,275,818 B2
(45) Date of Patent: Oct. 2, 2007

(54) PROCESS AND MATERIALS FOR MARKING PLASTIC SURFACES

(75) Inventors: Murray Figov, RaAnana (IL); Boaz Glass, ModiIn (IL); Alex Weiss, Kadima (IL)

(73) Assignee: Kodak IL Ltd., Petach Tikva ( * ) Notice: Subject to any disclaimer, the term of this patent is extended or adjusted under 35 U.S.C. 154(b) by 276 days.

(21) Appl. No.: 11/003,503

(22) Filed: Dec. 6, 2004

(65) Prior Publication Data

US 2005/0195260 A1 Sep. 8, 2005

Related U.S. Application Data

(63) Continuation-in-part of application No. PCT/IL2003/01072, filed on Dec. 16, 2003, application No. 11/003,503.

(60) Provisional application No. 60/534,119, filed on Jan. 5, 2004, provisional application No. 60/444,184, filed on Feb. 3, 2003.

(51) Int. Cl.
*B41J 2/01* (2006.01)

(52) U.S. Cl. ..... 347/101; 347/102; 347/105; 428/32.1

(58) Field of Classification Search ..... 347/101, 347/102, 105; 428/195, 32.1
See application file for complete search history.

(56) References Cited

U.S. PATENT DOCUMENTS

| | | | | |
|---|---|---|---|---|
| 5,670,260 | A * | 9/1997 | Zajaczkowski et al. | 428/345 |
| 5,688,738 | A | 11/1997 | Lu | |
| 5,936,008 | A * | 8/1999 | Jones et al. | 523/161 |
| 6,679,599 | B2 * | 1/2004 | Jurrens et al. | 347/102 |
| 2001/0036552 | A1 | 11/2001 | Otani et al. | |

FOREIGN PATENT DOCUMENTS

| | | |
|---|---|---|
| WO | WO97/27053 | 7/1997 |
| WO | WO99/21724 | 6/1999 |
| WO | WO 01/96098 | 12/2001 |

* cited by examiner

*Primary Examiner*—Stephen Meier
*Assistant Examiner*—Ly T. Tran
(74) *Attorney, Agent, or Firm*—Nelson Adrian Blish

(57) ABSTRACT

A method of producing ink-jet printed images with high resistance to physical and chemical damage on plastic surfaces, by coating the plastic object with an inkjet receptive layer comprising a mixture of hydrophilic polymers and UV curable pre-polymers deposited from an emulsion, ink-jetting an image onto the coating using ink-jet ink comprising a colorant and aqueous carrier, warming the printed surface to drive part of the water in the ink into the surface coating and to evaporate the other part of the water, UV curing the dried surface and over-coating the UV cured surface with lacquer or with lamination material.

3 Claims, 4 Drawing Sheets

PROCESS AND MATERIALS FOR MARKING PLASTIC SURFACES

CROSS-REFERENCE TO RELATED PATENT APPLICATIONS

This patent application is a continuation-in-part of PCT Patent Application No. PCT/IL2003/001072, filed 16 Dec. 2003, Publication No. WO 2004/069551, which claims priority from U.S. Provisional Patent Application No. 60/444,184, filed 3 Feb. 2003. This patent application also claims priority from U.S. Provisional Patent Application No. 60/534,119, filed 5 Jan. 2004.

FIELD OF INVENTION

The present invention relates to methods and compositions for providing suitable substrate coatings for printing on plastic surfaces, specifically of containers and identity cards, with aqueous ink jet inks.

BACKGROUND TO THE INVENTION

Packaging of all types of materials may require properties appertaining to functions involved in containing items and information about the use of such items. The container must have properties suited to the demands of the product. For instance, if the product is a liquid, then the container should be sealed to avoid spillage. If the liquid product is to be drunk, then the inside of the container must not contaminate the liquid nor cause its deterioration. Information of the product may be integral to the container or it may be separate. It may for instance have a function of aesthetically attracting a customer to the product or to instruct the customer how to use the product. As the product itself is generally what is being consumed, packaging provides an expense area that should perform its functions at a minimum cost. The printing of such packaging should have an optimum content of automation for this reason.

Modern technology has provided means of producing decorative and informative patterns of information on computers and it is desirable that this information be downloaded directly onto the packaging. One method of digital printing, which may be suitable for such applications, is inkjet. Inkjet is a non-impact printing process whereby ink is squirted through very fine nozzles and the resultant ink droplets form an image directly on a substrate. There are two main types of inkjet process. In one process, usually termed continuous inkjet printing (CIJ), a stream of ink drops are electrically charged and then deflected by an electric field either directly or indirectly onto the substrate. In the second process, usually called Drop on Demand (DOD) inkjet printing, the ink supply is regulated by an actuator such as a piezoelectric actuator. The pressure produced during the actuation forces a droplet through a nozzle onto the substrate. Inks for DOD inkjet printing do not need to be conductive.

WO 97/27053 by Jennel et al describes the use of inkjet to digitally write on packaging material. The printing can be done directly onto a pre-formed bottle such as one made from PET (polyester), or onto a carton blank or a web of packaging material. The invention is claimed to provide an advanced level of automation with minimum operator intervention. In order to achieve good adhesion to materials such as PET, ultra-violet (UV) sensitive inks are used and after jetting they are cured by UV radiation. The inkjet head is DOD and described as one supplied by the company Spectra. This is the most widely accepted way of using UV curing inkjet inks, as the alternative method, CIJ, generally uses water based inks and the inks must contain electrically conductive material. UV inks are generally based on organic acrylate mixtures that do not contain electrically conductive ingredients and are therefore less easily adapted for use in CIJ.

UV inkjet inks are more expensive than water-based inks and will remain so because by definition water-based inks contain a large quantity of water, which is relatively inexpensive. Because with UV inkjet inks all of the jetted material remains on the substrate surface (where the substrate is impermeable) inks are deposited in the form of tiny hemispherical structures. Process color work, where three or four separate inks are applied over the same area, can thus have a Braille-like feeling and such an effect limits print quality.

The use of water-based inks in packaging applications would be advantageous for several reasons. As has been mentioned above, they have cost advantages; they can be used in both DOD and CIJ inkjet systems and they do not pile-up because the major part of the inkjet drop is water, which disappears either by absorption, if the substrate is pervious, or by evaporation or both. However, there are a number of problems with using water-based inkjet inks in packaging. They have wetting problems with relatively low energy plastic surfaces (for instance that of PET) as well as slow drying, which for non-absorbent plastic surfaces has to occur only by evaporation. Also they have low wet smear resistance—i.e. after they have dried, they can be easily smeared with a wet finger. WO 99/21724 by Wang et als. addresses the problem of ink smearing. The patent application describes the use of two layers—an inner non-cross-linked hydrophilic coating and an outer cross-linked hydrophilic coating. In one embodiment, an inkjet image is applied before curing to avoid wet smear. Similarly, US 2001/0036552 by Otani et al. describes coating a substrate with two layers for water-based pigment inks to give better colors and image fastness.

In addition, there is a growing market for cards that may be used to show identity and carry out financial transactions. Cards have an expanding field of applications, including drivers' licenses, bank cards, loyalty cards, smart cards and telephone cards. The production of such cards, which may involve writing individual information is of interest, and inexpensive and easy methods of production are being sought. Ink-jet printing provides a promising basis for this industry, as it is now able to produce digital images of generally acceptable quality. However, ink-jet printing on plastic demands special approaches and must be adapted to reach the requirements for ID cards.

WO 01/96098 by Waller et al. describes the prior art for card making, starting with diffusion dye transfer methods as patented in U.S. Pat. No. 5,688,738 by Lu. The Waller application claims that current commercially available film and paper coatings are not suitable for aqueous based ink-jet inks because they are slow to dry, sensitive to humidity, and prone to delamination and damage from external water soaking. These problems are caused by the water and humectants present in the inkjet inks, which are retained by the image on the substrate. Wailer claims that the problems may be overcome by the use of ink retention layers, which include certain particles, to overcome the problems and to permit successful lamination.

BRIEF DESCRIPTION OF THE DRAWINGS

The following figures relate to the second embodiment of the invention

SUMMARY OF INVENTION

Figure 1:
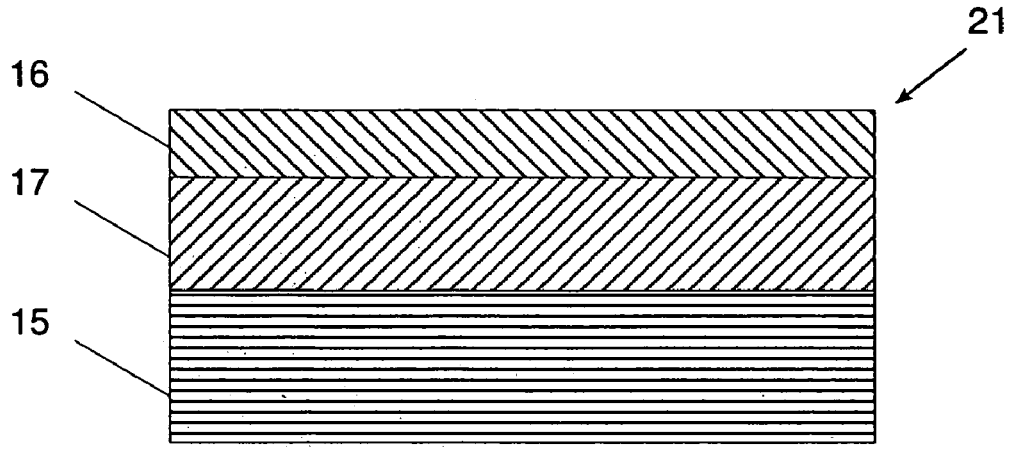
FIG. 1 is a diagrammatic representation of a card with a coated substrate.

In one embodiment of the present invention there is provided a method of producing ink-jet printed images with high resistance to physical and chemical damage on plastic surfaces, comprising the steps of: providing a plastic object coated with an inkjet receptive layer comprising a mixture of hydrophilic polymers and UV curable pre-polymers deposited from an emulsion; providing an ink-jet ink comprising a colorant and aqueous carrier; jetting the ink to form an image, by means of an ink-jet system, onto the surface of the coating of the plastic object; warming the printed surface to drive part of the water in the ink into the surface coating and to evaporate the other part of the water; UV curing the dried surface; and over-coating the UV cured surface.

In a second embodiment of the present invention there is provided a method of producing ink-jet printed images with high resistance to physical and chemical damage on plastic surfaces, comprising the steps of: providing a plastic object coated with an inkjet receptive layer comprising a mixture of hydrophilic polymers and UV curable pre-polymers deposited from an emulsion; providing an ink-jet ink comprising a colorant and aqueous carrier; jetting the ink to form an image, by means of an ink-jet system, onto the surface of the coating of the plastic object; warming the printed surface to drive part of the water in the ink into the surface coating and to evaporate the other part of the water; over-coating the dried surface with a UV curable overcoat; and UV curing the entire composite.

In a third embodiment of the present invention there is provided a method of producing ink-jet printed images with high resistance to physical and chemical damage on plastic surfaces, comprising the steps of: providing a transparent film lamination material coated with an inkjet receptive layer comprising a mixture of hydrophilic polymers and UV curable pre-polymers deposited from an emulsion; providing an ink-jet ink comprising a colorant and aqueous carrier; jetting the ink to form an image, by means of an ink-jet system, onto the surface of the coating; warming the printed surface to drive part of the water in the ink into the surface coating and to evaporate the other part of the water; UV curing the dried surface; and laminating said plastic surface onto the imaged surface.

In a fourth embodiment of the present invention there is provided a method of producing ink-jet printed images with high resistance to physical and chemical damage on plastic surfaces, comprising the steps of: providing a transparent film lamination material coated with an inkjet receptive layer comprising a mixture of hydrophilic polymers and UV curable pre-polymers deposited from an emulsion; providing an ink-jet ink comprising a colorant and aqueous carrier; jetting the ink to form an image, by means of an ink-jet system, onto the coated surface of the film; warming the printed surface to drive part of the water in the ink into the surface coating and to evaporate the other part of the water; laminating said plastic surface onto the dried surface; and UV curing the laminated object.

In all the embodiments, the UV curable emulsion may comprise urethane acrylates, preferably between 25% and 65% by weight.

DETAILED DESCRIPTION OF THE INVENTION

The present invention provides processes and composition for using aqueous ink-jet inks to print on plastic surfaces. The first embodiment is divided into two methods—Method I and Method II. In Method I of the first embodiment, this invention describes single coatings onto non-absorbent substrates on which aqueous inkjet inks are jetted with subsequent application of heat or other forms of energy to further cross-link the coating onto the substrate and to fuse the ink-jet ink image to give good quality water resistant colored reproductions.

The substrate coatings so described are primarily designed for use in automated packaging. Such coatings are single layers and are initially hydrophilic, preferably turning hydrophobic after aqueous inkjet imaging and curing. The changing nature of the coatings on curing permits both the initial absorption of the aqueous inkjet ink into the coating, followed by the fixing of the ink into the cross-linked matrix, resulting in very high rub resistance and where the coating becomes hydrophobic water rejection of the entire surface. As the application of Method I is designed for automatic packaging, it does not require the initial hydrophilic coating to be handled and therefore it may be of a fragile nature. As this is not the case with inkjet substrates as designed for less automated systems as specified in Method II of the first embodiment and in the second embodiment, there is a latitude in formulating such substrates which is wider than usual. Generally, substrate coatings are subject to handling—whether during manufacturing, packaging of the coatings or in the actual imaging process. For instance, they may require resistance to absorption of moisture from fingers and this would therefore restrict the content of hydrophilic constituents in the coating. In the present application, such coatings, whilst having characteristics of a solid film, may have poor adhesion to the substrate until after imaging and curing, when excellent adhesion can be achieved. Also, the coatings may only have a "shelf life" of a matter of minutes, as they may be immediately used and processed as described herein. The coatings may be applied to a wide range of substrates, but are particularly suitable for plastics such as polyester (PET) and polyvinyl chloride (PVC). The coating may be pigmented or transparent, depending on the application. A substrate with a white pigment, either incorporated therein or incorporated in the substrate coating, has wide application as it provides an essential background for transparent process inks. In the case of a coating, it can be applied to a designated area of the substrate and the inkjet inking can be used in just this area. This is particularly useful for bottles of drink where the color of the drink can be seen through the transparent parts of the bottle and the bottle can still have an attractive aqueous inkjet image affixed to a white area provided by the substrate coating.

Method II of the first embodiment may be done as a manufacturing process for supplying the coated substrate to the customer. The customer will then image the coated substrate with the aqueous inkjet inks and cross-link them to produce the finished item. In such an application, the substrate together with its coating must be able to be handled and the coating itself must have a shelf life of at least several months to allow time for distribution and use.

It is preferable but not essential to deposit the substrate from aqueous solution.

It is also preferable, depending on the application, that the substrate materials are chosen from only those approved for food items, making their use in the food and drink industry applicable.

The method of application as applied to an automated production line is as follows:

apply the solution of substrate coating to the plastic surface;

air-dry to evaporate the water or solvent;

apply the aqueous inkjet inks in the form of the required image; and treat with heat or another form of energy to cross-link and fix the inkjet image into the substrate.

This method will be referred to below as the first embodiment.

In the second embodiment, specifically applicable to cards, the substrate coatings and initial drying is done as a manufacturing process for supplying the coated substrate to a customer. The customer will then image the coated substrate with the aqueous inkjet inks and cross-link them and then preferably apply a protective coat to produce the finished item. This method will be referred to below as the second embodiment. In order to understand the three different methods of the second embodiment, reference is made to the Figures. The three different methods will be described as Method III, Method IV and Method V and all refer only to the second embodiment.

Figure 3:
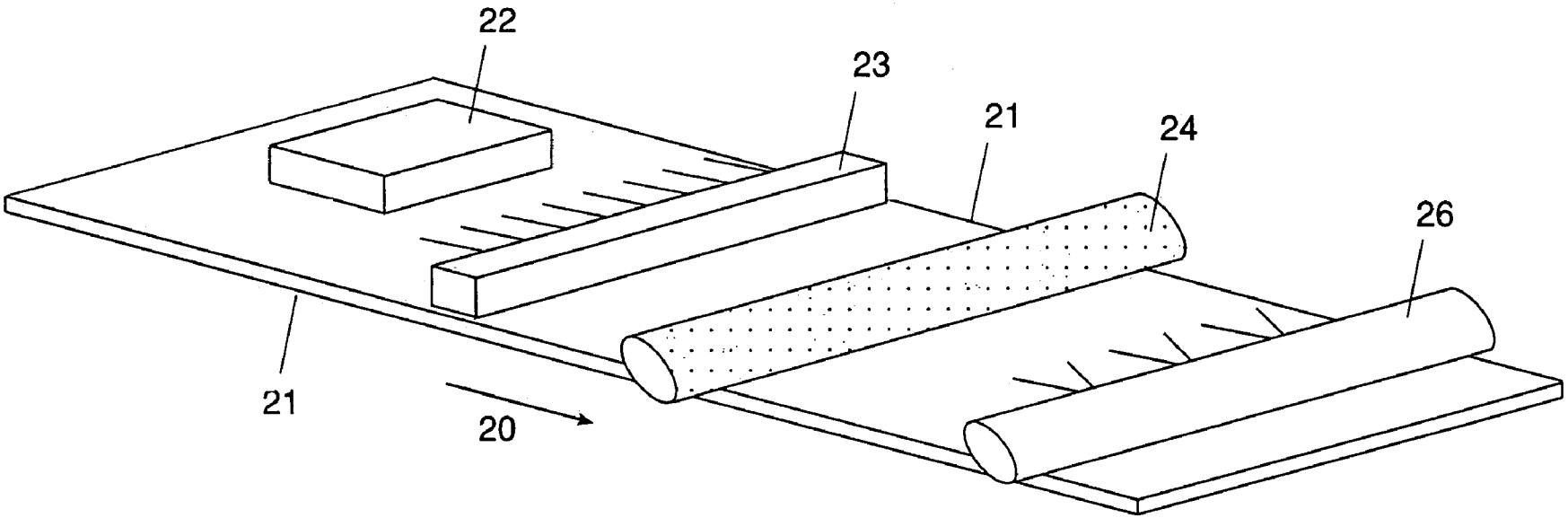
FIG. 3 is a diagrammatic representation of a first embodiment of the present invention, where a UV curable lacquer is applied as a fixing stage.

FIG. 1 shows the card substrate 15 covered with an under-coat 16. The term under-coat is used herein to describe the coating onto which the ink-jet image in the form of inks is deposited. It is possible to have an additional optional second coat 17, situated between the substrate 15 and the under-coat 16. Together 15, 16 and 17 constitute the coated card material herein designated 21. Coating 17 may be pigment loaded to impart opacity if necessary and if the substrate is transparent. It may also be hydrophilic to encourage the absorption of humectant and water from the ink-jet inks during post-image warming. Optionally, it may be heat- or UV-curable FIG. 3 is a diagrammatic representation of the means and process for imaging the coated card of FIG. 1 denoted Method III. The coated card material 21 enters the ink-jet printing area 22 and is imaged. This image may comprise multiple colors and may include pictures and text.

After the card is imaged, it is preferable to warm the surface to allow the water from the ink-jet inks deposited to at least partially evaporate and to drive the remnants of the water and any humectant into the under-coating 16.

In a preferred process, the card passes under a coating unit 24, where a layer of liquid UV-sensitive pre-photopolymer is applied to the entire surface. Such lacquers are well known in the art as UV overprint materials and are used as over-coat lacquers for printing for instance paperback book covers. The coating unit 24 may comprise a reservoir for the UV lacquer and a coating roller which may have surface cells in the form known as Anilox for carrying the lacquer. The lacquer is solvent free, being a combination of oligomers, monomers and photoinitiators.

The card then passes under a lamp 26 radiating UV light of suitable wavelength, which cures simultaneously the under-layer (16 and 17 if this coating is UV-curable) with the ink-jet image absorbed into it and the over-layer lacquer. The exposure speed should be the same as the imaging speed, as the two are part of the same moving path. The ink-jet printing step is relatively slow compared to the speeds that can be achieved in polymerization by UV exposure. Therefore, the UV source can vary from high-pressure mercury vapor down to fluorescent lamps rich in UV.

Alternatively, the over-coat lacquer may be a self cross-linking polymer in a water emulsion. It has been found that urethane/acrylate copolymers are especially effective.

Figure 4:
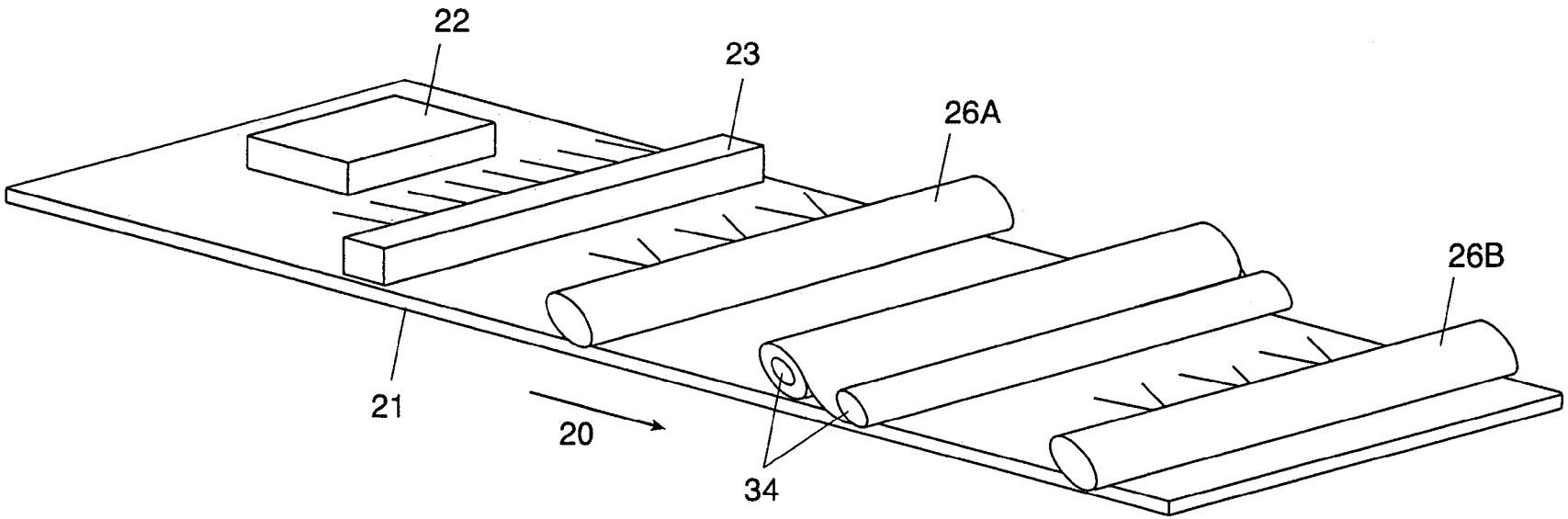
FIG. 4 is a diagrammatic representation of a second embodiment where a transparent laminated film is applied as the fixing stage.

FIG. 4 is a diagrammatic representation of Method IV of means and process for imaging the coated card of FIG. 1. The card material 21 enters the ink-jet printing area 22 and is imaged. The warming unit 23 functions as previously described. It is possible to UV cure the imaged material at this stage with UV unit 26A, or after lamination with UV curing unit 26B. A laminating unit 34 feeds the clear laminate film onto the surface of the imaged card and then heat bonds the film as a protective layer as is known in the art.

Figure 2:
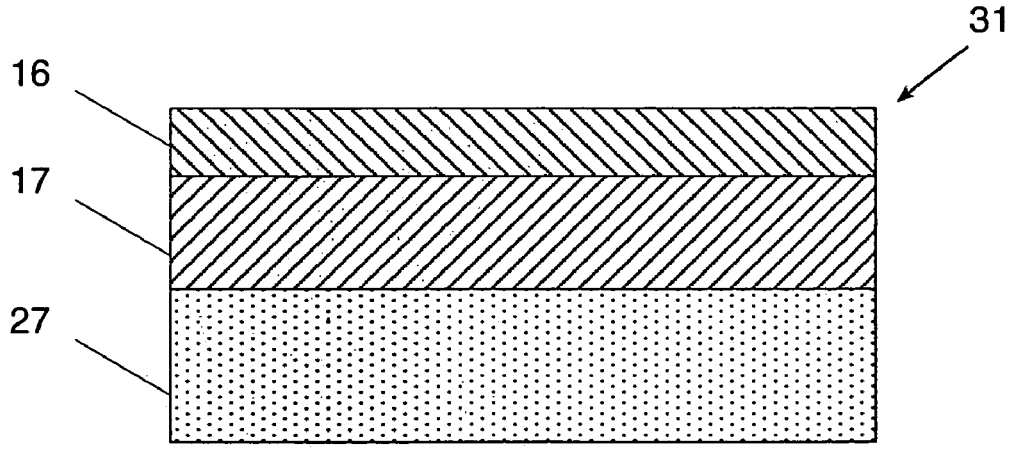
FIG. 2 is a diagrammatic representation of a transparent film with a coated substrate.
Figure 5:
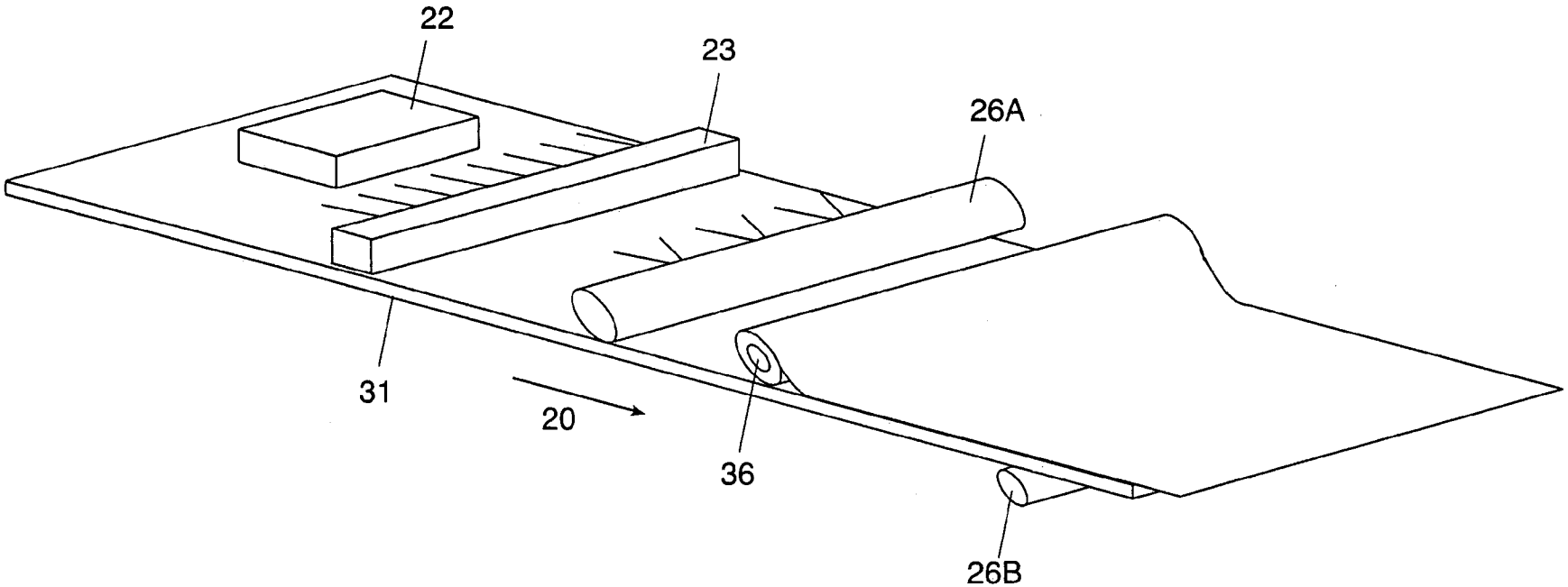
FIG. 5 is a diagrammatic representation of a third embodiment where the laminate transparent polyester film overlayer coated with the ink receptive under-layer is imaged.

Method V uses a transparent film lamination material 27, as shown in FIG. 2, coated with the ink-jet ink receptive undercoat layer 16. It is possible to have an additional optional second coat 17, situated between the film 27 and the under-coat 16. The composite is designated 31. The composite 31 may receive the image as a lateral inversion and is warmed by unit 23, as shown in FIG. 5. As previously, the UV lamp units 26A and/or 26B are used for curing. The card material is fed from a reel of material 36 as part of the laminator and is then laminated by heat/pressure onto the imaged side of the transparent film. If the UV curing is made at station 26B, then this is done through the transparent film from the underside of the machine as shown in the diagram.

The process of the present invention may be built around a suitable commercially available ink-jet printer. An example of such a printer is the Epson Stylus C82. This printer uses aqueous pigmented ink-jet inks, which are preferred over dye-based inks, which may also be used.

For Methods III and IV as depicted in FIGS. 1, 3 and 4, if the card material is too thick the feed of the machine must be modified to deliver either individual cards or a sheet which can be cut up into cards after printing. Alternatively the card material may have a thickness suitable for the existing machine and the over-coating layer or laminating layer may be sufficiently thick to give the overall substance of the card required from the market. Individual cards may be conveyed using a holder in the form of a carrier sheet into which they fit.

For Method V of the second embodiment depicted in FIGS. 2 and 5, the feed of the machine need not be modified. The image must be laterally inverted for printing on the polyester, which constitutes the over-layer laminate. The coating on the polyester must be transparent and the card itself must be white and opaque.

Where appropriate, it is possible to apply the first embodiment to cards and the second to packaging. In both embodiments a final stage of applying a laminate or protective layer can be made for extra protection against surface damages.

It is part of the invention that the color quality of the inkjet image is retained or achieved after the applied energy finishing stage has been completed to finalize the cross-linking process. Aqueous inkjet inks may be based on dye colorants or pigments and may contain technologies to enhance drying and wet strength. Thus, although, with some aqueous ink formulations it may be possible to insolubilize them on uncoated plastic substrate, because of surface energy considerations, image quality may be lost completely as the inks often reticulate on plastic surfaces.

In the instance of the first embodiment, suitable substrate coating formulations may be water-based mixtures of polyvinyl alcohol and polyacrylic acid together with a water based emulsion containing a hydrophobic polymer in the internal phase and stabilized at a pH of 7 or less. In addition, a water-soluble cross-linker such as an aminoplast is used together with a catalyst. In the embodiments where the coated substrate is manufactured prior to subsequent final inkjet imaging and thus must have shelf life, the catalyst should be one only activated when energy is applied. An example of a suitable catalyst is an amine hindered para toluene sulfonic acid.

In both of the above methods of the first embodiment, the mixture can also contain titanium dioxide or a mixture of white or opaquing pigments dispersed therein.

Mixtures of use in this invention, when deposited on a plastic substrate can be dried with warm air and give solid films. Deposition may be by spraying or by any other suitable means of coating.

Suitable formulations may be also solvent-based mixtures of cellulose derivatives such as hydroxypropyl cellulose, which may be deposited from solvent mixtures such as alcohol/ethyl acetate mixtures. The formulation should contain solvent soluble aminoplast cross-linkers and appropriate catalysts. They may be deposited and treated in a similar fashion to the water based coatings and can be used for the automated or less automated applications.

A third type of formulations may be based on pre-polymeric mixtures that in the presence of photo-initiators can be polymerized by ultra-violet light. In order to achieve the initial hydrophilic properties, suitable hydrophilic polymers and extenders may be added. It is also important to arrive at a solid film before the deposition of the inkjet inks. Whilst this type of formulations applies to the two methods of the first embodiment of the invention it is the only type of formulation applicable to the under-coat 16 of all of the three methods of the second embodiment Such formulations provide coatings that have the combined properties of good performance when imaged with ink-jet inks and also may be hardened by UV curing. The curing process makes the coating itself resistant to chemicals and water and helps fix the ink-jet ink which has been absorbed into the layer. An additional over-layer or a laminate gives the added protection against handling problems such as scratching and abrasion that are experienced during the life-time of cards.

It has been found that suitable acrylic pre-polymer material, which may be cross-linked with UV light by means of a photoinitiator, may be used in the form of water-based emulsions as this may be combined with elements of the formulation designed to encourage good quality ink-jet imaging. The acrylic polymer itself is oleophilic and if it was the only material used in the substrate coating it would not provide absorption of the aqueous ink-jet ink, as it would form a coat having too low a surface energy. Moreover, after drying by evaporation of the water in the emulsion it would form a non-solid sticky liquid film, which could not be provided to the customer for imaging, as it would not be easily packaged nor handled. If the coating was solidified by polymerization by UV exposure it would not absorb the ink-jet ink at all. Thus the added ingredient in the formulation of the substrate coating must be such that a solid film is formed, whilst the entire coating retains the property of being UV curable into a resistant film after ink-jet imaging.

Examples of suitable UV polymerizable emulsions are Neorad R-440, R-441 and R-445. These are urethane acrylates. It has been found that they are effective in a range of percentage solids between 25% and 65% by weight. Preferably, the percentage of these materials in the solids is in the range of 45% to 55% by weight. Too much of these materials give coatings before UV curing which do not give good images with aqueous ink-jet inks because of the low surface energy of the layer. After water evaporation, the urethane acrylate emulsion forms a film, which without any other additives is liquid. Therefore, too much of the emulsion in the complete formulation would give a layer which remains liquid or sticky and cannot be handled or stored. Too little material does not impart the post-image/post-curing water insoluble properties to the coating.

As is well known in the art, the UV polymerizable materials must also have present photoinitiators, which under the influence of UV light provide the free radicals necessary for polymerization. In the case of UV polymerizable acrylic emulsions, the photoinitiators are preferably liquids, which may be stirred in with the emulsion and enter into the internal phase where they can react most effectively. Such photoinitiators must be sensitive to UV light in the wave-length of the source used in the system. Examples of suitable photo-initiators are Esacure KTO46. and Irgacure 1173. It is also possible to dissolve solid photoinitiators into water-soluble solvents such as ethyl alcohol and to introduce them into the system by this means. In this case, care must be taken to avoid disrupting the emulsion with the solvent used.

An alternative approach to the formulation is to use mixtures based on organic solvents as the carrying liquids. In this case, the oligomers or monomers can be chosen from a wider selection, as can the photoinitiator. The underlying principle is to have a combination of a formulation that forms good coating on plastic, absorbs aqueous ink-jet to give good images and can then be polymerized by exposure to UV light to give material more resistant to handling.

The other ingredients used in formulating under-layer 16 comprise polymers and extenders known in the art. They must not exceed 75% by weight of the total solids of the coating, as more than this destroys the UV curing hardening properties imparted by the acrylate emulsion.

The coating weight may be anything from 2 to 30 grams per square meter, but 18 grams per square meter appeared to give optimum results. This permits adequate absorption of all of the humectants and water that is deposited as part of the ink-jet inks.

Preferably, the coating is applied using water as the carrying liquid although, as explained above, solvent carrying systems are also suitable. The coating may or may not be transparent. If it is white and completely opaque, then the card need not be opaque; but it is preferable that the card should be white and opaque.

The following examples illustrate the processes as described. All formulations are given by weight.

EXAMPLE I

This example provides a formulation that can be applied in both methods of the first embodiment.

| | |
|---|---|
| Polyvinyly alcohol solution (12% in water) | 22.4 |
| Deionized water | 115 |
| Polyacrylic acid (35% in water) | 32 |
| Super Wetting Agent (Q2-5211 Manufactured by Dow Corporation, Midland, MI, USA) | 4 |
| Walpol 40-136 Vinyl-acrylic latex polymer (Reichold Inc., Research Triangle Park, NC, USA) | 37 |

-continued

| | |
|---|---|
| Cymel UFR-60 Methoxymethyl methylol urea by Cytec Industries, Five Garret Mountain Plaza, West Patterson, NJ, USA) | 13.5 |
| Cycat 4045 (amine inhibited toluene sulfonic acid) Cytec Industries, Five Garret Mountain Plaza, West Patterson, NJ, USA) | 8 |

The above-enumerated mixture was made up and high-speed stirred. A 175-micron polyester loaded with barium sulfate to give a white opaque appearance was used as the substrate. This was coated with the above formulation solution using a Mayer rod and the coating was air dried overnight at room temperature. The film formed on the polyester had a coating weight of approximately 2.6 grams per square meter. This was passed through an Epson 7600 and a colored image using aqueous pigment-based "Ultrachrome" inks was deposited on the coating. The resulting print was then heated for 4 minutes at 140° C. and gave a high quality water-fast reproduction.

EXAMPLE II

This example provides a formulation that can be applied in both methods of the first embodiment.

| | |
|---|---|
| Polyvinyly alcohol solution (12% in water) | 22 |
| Deionized water | 111 |
| Polyacrylic acid (35% in water) | 35 |
| Super Wetting Agent (Q2-5211 Manufactured by Dow Corporation, Midland, MI, USA) | 4 |
| Walpol 40-136 Vinyl-acrylic latex polymer (Reichold Inc., Research Triangle Park, NC, USA) | 37 |
| Cymel UFR-60 Methoxymethyl methylol urea by Cytec Industries, Five Garret Mountain Plaza, West patterson, NJ, USA) | 14 |
| Cycat 4045 (amine inhibited toluene sulfonic acid) Cytec Industries | 8.6 |
| Kronos 2065 (Kronos Inc. Huston, Texas, USA) | 53.8 |
| Ethanol | 80 |

The above-enumerated mixture was made up and ball-milled overnight. A 175-micron transparent polyester was used as the substrate. This was coated with the above formulation solution using a Mayer rod and the coating was air dried overnight at room temperature. The film formed on the polyester had a coating weight of approximately 8.7 grams per square meter. This was passed through an Epson 7600 and a colored image using aqueous pigment-based "Ultrachrome " inks was deposited on the coating. The resulting print was then heated for 4 minutes at 140° C. and gave a high quality water-fast reproduction.

EXAMPLE III

This example provides a formulation that can be applied in both methods of the first embodiment.

| | |
|---|---|
| Glasscol C44 (styrene/acrylic copolymer emulsion sold by Ciba Speciality Chemicals, Macclesfield, UK)) | 8.7 |
| Water | 15.7 |
| BYK 346 (surfactant sold by BYK-Chemie GmbH, Postfach, Germany. | 0.3 |
| Polyvinyl alcohol solution (12% in water) | 2.0 |

-continued

| | |
|---|---|
| Kronos 2065 (titanium dioxide sold by Kronos Inc., Huston, Texas, USA | 6.6 |
| Cabosil M5 (Untreated fumed silica sold by Cabot Corporation, Tuscola, IL, US) | 0.94 |

The above enumerated mixture was made up with stirring after each addition and ball-milled overnight.

5 grams of the above mixture was then mixed with the following ingredients:

| | |
|---|---|
| Water | 3.2 |
| UFR-60 (aminoplast by Cytec Industries, West Patterson, NJ, USA) | 0.86 |
| Cycat 4045 (catalyst by Cytec Industries, West Patterson, NJ, USA.) | 0.19 |

The final mixture was coated on a 175-micron clear polyester film. The coating mixture was applied using a wire wound rod and was dried at 110° C. for 4 minutes to a dry weight of approximately 12 grams per square meter. The sheet was then imaged in an Iris Realist 2-Print proofer which uses dye based aqueous inks with a full process color image. The print was warmed for one minute at 110° C. and then coated with the following solution:

Daotan VTW 6462 w/36WA(self-cross-linking aliphatic

| | |
|---|---|
| urethane acrylate hybrid sold by Solutia, St. Louis, MO, USA.) | 14.5 |
| BYK 346 | 0.14 |

The coating mixture was applied with a wire rod and cured in the oven. at 140° C. for 4 minutes. The dry weight of the over-coat was approximately 5 grams per square meter. Although the coating was applied to the dried dye-based aqueous inks by pressing the wire rod in contact with the surface, surprisingly no bleeding nor smudging was observed either during coating or during drying/curing. The resulting print had high gloss and high solvent resistance. For instance, the finished print was soaked for 24 hours in 70% by weight isopropanol (25% water). After drying, the print showed no damage and could be rubbed without effecting the material and image. Other emulsion top-coats were used. It was found that self cross-linking urethane acrylate hybrids gave the best solvent resistance.

EXAMPLE IV

This example provides a formulation that can be applied in Method I of the first embodiment.

The mixture of Example III was made up with one difference. Cycat 4045 was replaced by Cycat 4040 (Cytec Industries)—a toluene sulfonic acid solution that acts as a catalyst for cross-linking amoniplasts. The mixture was sprayed onto a PET bottle to give an even coating of approximately 12 grams per square meter. The bottle was air-dried at ambient conditions and provided a white opaque ink jet receptive surface. It was then imaged using a Iris ink jet heads mounted on a lathe with the bottle fixed to rotate close to the ink jet heads. A good quality image was obtained and this was warmed with an air gun to dry the image. It was then sprayed with the overcoat of Example III and again dried with the air gun. No image bleeding was observed. The bottle was immediately scuff resistant but was left for a week during which the undercoat continued to harden by means of the aminoplast cross-linking with the polyvinyl alcohol in the presence of the toluene sulfonic acid catalyst.

EXAMPLE V

The formulation of this example can be applied in all methods and embodiments.

The following formulation was made up by weighing out each ingredient into a bottle in the order shown and stirring the mixture after each addition;

| | |
|---|---|
| NeoRad R-440 (Aliphatic urethane water dispersion by Avecia, Neoresins, Wilmington, MA, USA.) | 110 |
| Escacure KTO46 (photoinitiator mixture by Lamberti s.p.a. Produti Chimici, Gallarate VA, Italy) | 3.2 |
| Starch | 4.8 |
| PVP-K15 (polyvinyl pyrollidone by ISP Europe, Surrey, England) | 4.8 |
| BYK 346 | 2.2 |
| Ti-Pure 746 (Titanium dioxide dispersion by Titanium Technologies, Wilmington, DE, USA) | 1.6 |
| Ludox TM-40 (colloidal silica -40% in water sold by Sigma-Aldrich Chemical Company, Milwaukee, USA) | 80.6 |
| Glasscol C44 | 11.1 |

The completed mixture was stirred and then coated onto a 175-micron white polyester and dried at 110° C. for a minute, to a dry thickness of approximately 12 grams per square meter.

The coated polyester was imaged with a multicolored image through an Epson C82 Stylus ink jet printer. The image was warmed (1 minute at 110° C.) to drive any water either into the coating or away from the coating by evaporation as well as to drive humectants in the inks into the coating. The imaged material was then further coated with a 100% solids UV-sensitive lacquer and the entire composite subject to UV light to cure both the under-coat and the overcoat, as well as to fix the image firmly within the system. Alternatively, the UV lacquer was omitted and the imaged material was UV cured to cross-link the entire coating, trapping within the coating the dried ink jet inks.

The imaged coated polyester was then exposed by passing under a high-pressure mercury vapor lamp at a power of 300 watts per inch, at a speed of 10 feet per minute.

The invention claimed is:

1. A method of producing ink-jet printed images with high resistance to physical and chemical damage on plastic surfaces, comprising the steps of:

providing a transparent film lamination material coated with an inkjet receptive layer comprising a mixture of hydrophilic polymers and UV curable pre-polymers deposited from an emulsion;

providing an ink-jet ink comprising a colorant and aqueous carrier;

jetting the ink to form an image, by means of an ink-jet system, onto the coated surface of the film;

warming the printed surface to drive part of the water in the ink into the surface coating and to evaporate the other part of the water;

laminating said plastic surface onto the dried surface; and UV curing the laminated object.

2. The method according to claim 1, wherein the emulsion comprises urethane acrylates.

3. The method according to claim 2, wherein the urethane acrylates comprise between 25% and 65% by weight of the UV curable emulsion.

* * * * *